US005540012A

United States Patent [19]

Clegg

[11] Patent Number: 5,540,012

[45] Date of Patent: Jul. 30, 1996

[54] METHOD OF INCREASING THE RANGE OF CONTROLLED MOVEMENT OF A DOOR OPENED BY A TREADLE OPERATED DOOR OPENING ASSEMBLY, AND A TREADLE OPERATED DOOR OPENING ASSEMBLY

[76] Inventor: Michael Clegg, 10029 - 93 Street, Edmonton, Alberta, Canada, T5H 1W6

[21] Appl. No.: 295,547

[22] Filed: Aug. 25, 1994

[51] Int. Cl.[6] ..... E06B 7/00

[52] U.S. Cl. ..... 49/70; 49/263; 49/274; 49/386; 312/275; 312/321.5

[58] Field of Search ..... 49/263, 274, 70, 49/356, 386, 506, 507; 312/275, 321.5, 319.9, 291, 292

[56] References Cited

U.S. PATENT DOCUMENTS

| | | | |
|---|---|---|---|
| 885,570 | 4/1908 | Bergquist | 49/274 |
| 1,315,143 | 9/1919 | Masters | 312/319.9 |
| 2,117,663 | 5/1938 | Hill | 312/275 |
| 2,170,677 | 8/1938 | Berg | 312/319.9 |
| 2,554,048 | 5/1951 | Morrison et al. | 312/321.5 |
| 2,837,395 | 6/1958 | Carani | 312/274 |
| 3,014,684 | 12/1961 | Gould, Jr. | 312/275 |
| 3,316,047 | 6/1965 | Murphy | 312/275 |
| 3,364,621 | 1/1968 | Erickson | 312/319.9 |
| 3,378,323 | 4/1968 | Goldberg | 312/319.9 |
| 4,870,315 | 9/1989 | Neuhaus | 312/275 |
| 4,911,508 | 3/1990 | Tillman | 312/319.9 |
| 5,149,179 | 9/1992 | Nash | 312/321.5 X |

*Primary Examiner*—Philip C. Kannan
*Attorney, Agent, or Firm*—Anthony R. Lambert

[57] ABSTRACT

A method of increasing the range of controlled movement of a door opened by a treadle operated door opening assembly is described, along with a treadle operated door opening assembly constructed in accordance with the teachings of the method. The method includes the step of mounting a contact member which projects from the first face of the door adjacent to the hinge edge and the bottom edge. With this modification when a person treads upon a radially extending pedal a shaft rotates causing a point of contact between the arm and the door to move sequentially from a first position substantially parallel to the first face of the door to a second position engaging the contact member substantially perpendicular to the first face of the door.

5 Claims, 5 Drawing Sheets

METHOD OF INCREASING THE RANGE OF CONTROLLED MOVEMENT OF A DOOR OPENED BY A TREADLE OPERATED DOOR OPENING ASSEMBLY, AND A TREADLE OPERATED DOOR OPENING ASSEMBLY

The present invention relates to a method of increasing the range of controlled movement of a door opened by a treadle operated door opening assembly, and a treadle operated door opening assembly.

BACKGROUND OF THE INVENTION

Treadle operated door openers generally consist of a rotatably mounted shaft with a radially projecting door engaging arm at one end and a radially extending pedal at the other end. When a person treads upon the pedal the shaft rotates causing the arm to push the door open. The problem with treadle operated door openers is that they tend to throw the door open rather than open the door in a controlled manner. This is especially true when the arm is located away from the hinge side of a door that pivots about a substantially vertical axis. When the arm is located immediately adjacent the hinge side of the door the problem is less acute. The arm is only able to maintain contact with the door, however, until the door is partially opened and must throw the door open the rest of the way.

SUMMARY OF THE INVENTION

What is required is a treadle operated door opener which will open a door in a more controlled manner.

According to one aspect of the present invention there is provided a method of increasing the range of controlled movement of a door opened by a treadle operated door opening assembly. Treadle operated door opening assemblies have a structure which includes a generally rectangular door frame having a top, a bottom and opposed sides. A door is pivotally mounted by means of hinges to one of the opposed sides of the door frame for pivotal movement about a substantially vertical axis. The door has a first face, a second face, a top edge, a bottom edge, a hinge edge, and an opening edge. A shaft is rotatably mounted adjacent the bottom of the door frame. The shaft has a first end and a second end. A radially extending arm is positioned adjacent the first end of the shaft. A radially extending pedal is positioned adjacent the second end of the shaft. When a person treads upon the pedal the shaft rotates causing the arm to engage the first face of the door adjacent the hinge edge to push the door open. The method includes the step of mounting a contact member which projects from the first face of the door adjacent to the hinge edge and the bottom edge. With this modification when a person treads upon the pedal the shaft rotates causing a point of contact between the arm and the door to move sequentially from a first position substantially parallel to the first face of the door to a second position engaging the contact member substantially perpendicular to the first face of the door.

The method, as described above, enables the force of the arm to be transferred from the first face of the door to the contact member as the door swings away from the arm. The arm is, therefore, in contact with the door via the contact member for a longer period than previously was the case enabling the range of controlled movement of the door to be increased.

Although beneficial results may be obtained through the method, as described above, once the teachings of the method are known there are ways to enhance the interaction of the arm with the contact member. Even more beneficial results are obtained when the contact member has a curved contact surface having a first end and a second end. The first end is substantially parallel to the first face of the door and the second end is substantially perpendicular to the first face of the door. The curved contact surface provides a smoother transition in the movement of the arm from the first position to the second position. Even more beneficial results may be obtained when the arm is bent away from the hinge edge of the door. With a bent arm the arm is less likely to scratch the door and there is increased contact between the arm and the contact member.

According to another aspect of the present invention there is provided a treadle operated door opening assembly which includes a generally rectangular door frame having a top, a bottom and opposed sides. A door is pivotally mounted by means of hinges to one of the opposed sides of the door frame for pivotal movement about a substantially vertical axis. The door has a first face, a second face, a top edge, a bottom edge, a hinge edge, and an opening edge. A contact member projects outwardly from first face of the door adjacent to the hinge edge and the bottom edge. A shaft is rotatably mounted adjacent the bottom of the door frame. The shaft has a first end and a second end. A radially extending arm is positioned adjacent the first end of the shaft. A radially extending pedal is positioned adjacent the second end of the shaft. When a person treads upon the pedal the shaft rotates causing the arm to sequentially engage initially the first face of the door and then the contact member to open the door in a controlled manner.

The above described apparatus is constructed in accordance with the teachings of the method described above. It is preferred that the contact members have a curved contact surface and that the arm be bent away from the hinge edge of the door.

Although beneficial results may be obtained through the use of the apparatus, as described above, even more beneficial results may be obtained when the apparatus is combined with a door mounted container. A container is secured to the first face of the door. The container has a lid with a first end pivotally mounted for movement about a substantially horizontal axis and a second end. A string extends from the second end of the lid to the top of the door frame. As the door opens the lid is drawn by the string into an open position.

Although beneficial results may be obtained through the use of the apparatus, as described above, it is desirable to have some mechanism that assists in closing the door. Presumably, the reason one wishes to use a treadle operated door opening assembly is because ones hands are otherwise occupied. Even more beneficial results may, therefore, be obtained when a spring extends between the container and the second end of the lid. The spring provides a biasing force to draw the lid back into a closed position and the door back into the closed position when foot pressure is released from the pedal.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
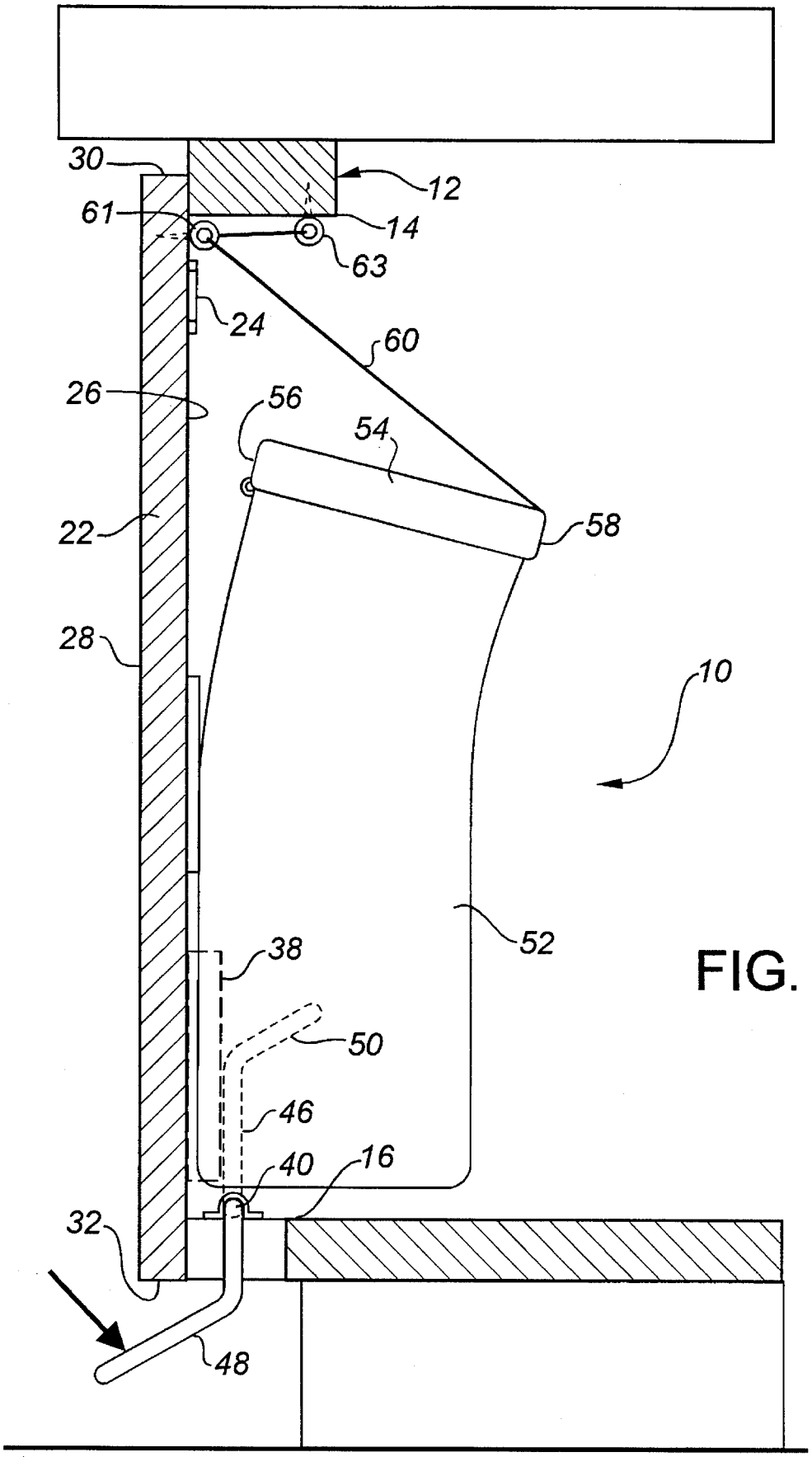
FIG. 1 is a side elevation view in section of a treadle operated door opening assembly constructed in accordance with the present invention, the door being closed.

The invention relates to a method of increasing the range of controlled movement of a door opened by a treadle operated door opening assembly. There will first be described a treadle operated door opening assembly constructed in accordance with the teachings of the method. The preferred embodiment, a treadle operated door opening assembly generally identified by reference numeral 10, will now be described with reference to FIGS. 1 through 6.

Figure 2:
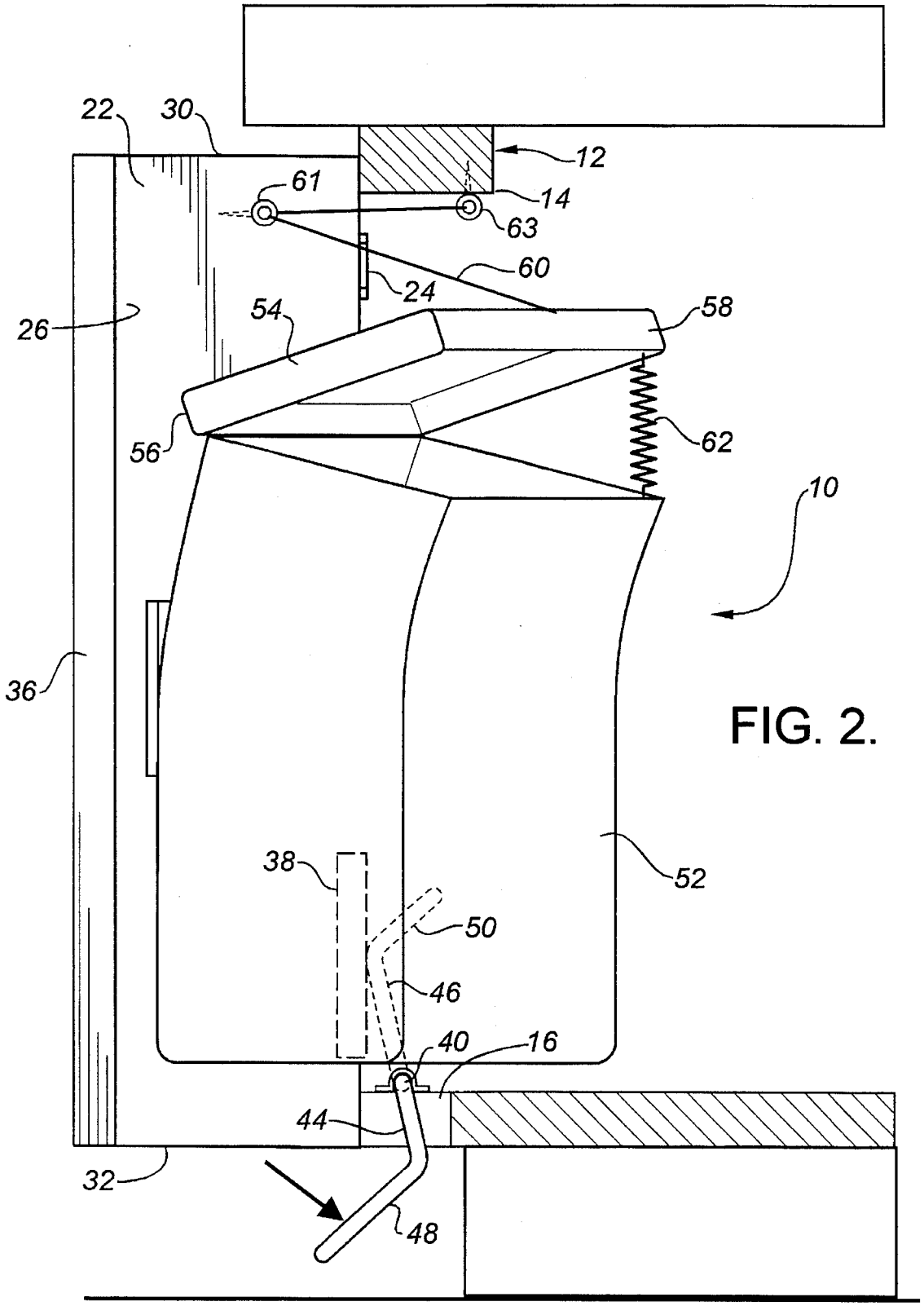
FIG. 2 is a side elevation view in section of the treadle operated door opening assembly illustrated in FIG. 1, the door being partially open.
Figure 4:
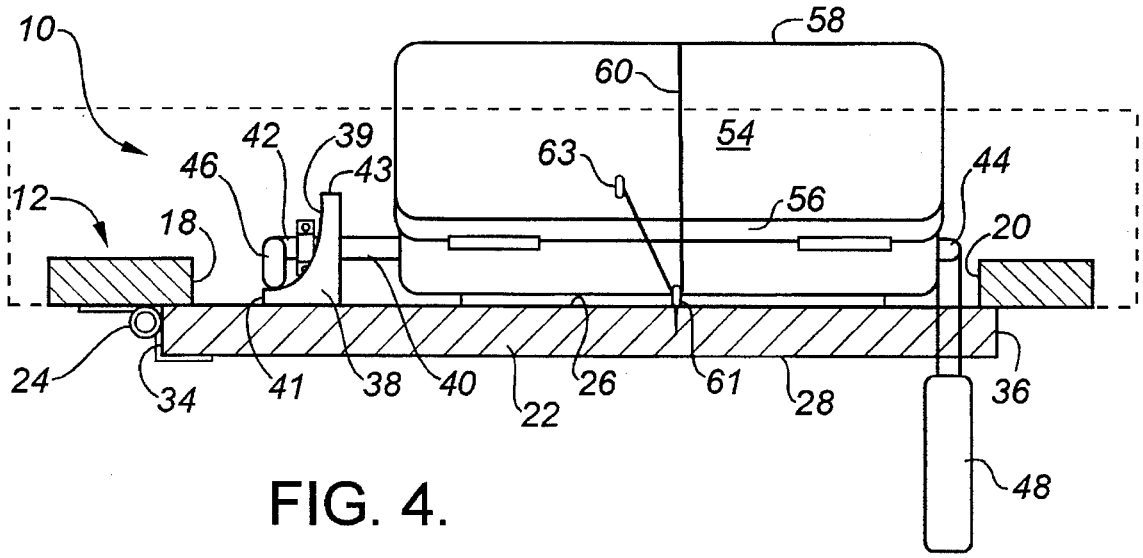
FIG. 4 is a top plan view of FIG. 1.

Treadle operated door opening assembly 10 includes a generally rectangular door frame 12 having a top 14 and a bottom 16 (as illustrated in FIG. 1) as well as opposed sides 18 and 20 (as illustrated in FIG. 4). Referring to FIG. 4, a door 22 is pivotally mounted by means of hinges 24 to side 18 of door frame 12 for pivotal movement about a substantially vertical axis. Door 22 has a first face 26 and a second face 28, a hinge edge 34, and an opening edge 36 (as illustrated in FIG. 4) as well as a top edge 30 and a bottom edge 32 (as illustrated in FIG. 1) . Referring to FIG. 4, a contact member 38 extends substantially perpendicularly from first face 26 of door 22 adjacent to hinge edge 34 and bottom edge 32. Contact member 38 has a curved contact surface 39 with a first end 41 and a second end 43. First end 41 is substantially parallel to first face 26 of door 22. Second end 43 is substantially perpendicular to first face 26 of door 22. Referring to FIG. 1, a shaft 40 is rotatably mounted to bottom 16 of door frame 12 adjacent bottom edge 32 of door 22. Referring to FIG. 4, shaft 40 has a first end 42 and a second end 44. A radially extending arm 46 is positioned adjacent first end 42 of shaft 40. A radially extending pedal 48 is positioned adjacent second end 44 of shaft 40. Referring to FIG. 1, arm 46 has a bent portion 50, which is bent away from hinge edge 34 of door 22. A container 52 is secured to first face 26 of door 22. Container 52 has a lid 54 with a first end 56 pivotally mounted for movement about a substantially horizontal axis and a second end 58. A string 60 extends from second end 58 of lid 54 to a first eyelet 61 on first face 26 of door 22 above lid 54 and then to a second eyelet 63 on top 14 of door frame 12. Referring to FIG. 2, a spring 62 extends between container 52 and second end 58 of lid 54.

Figure 3:
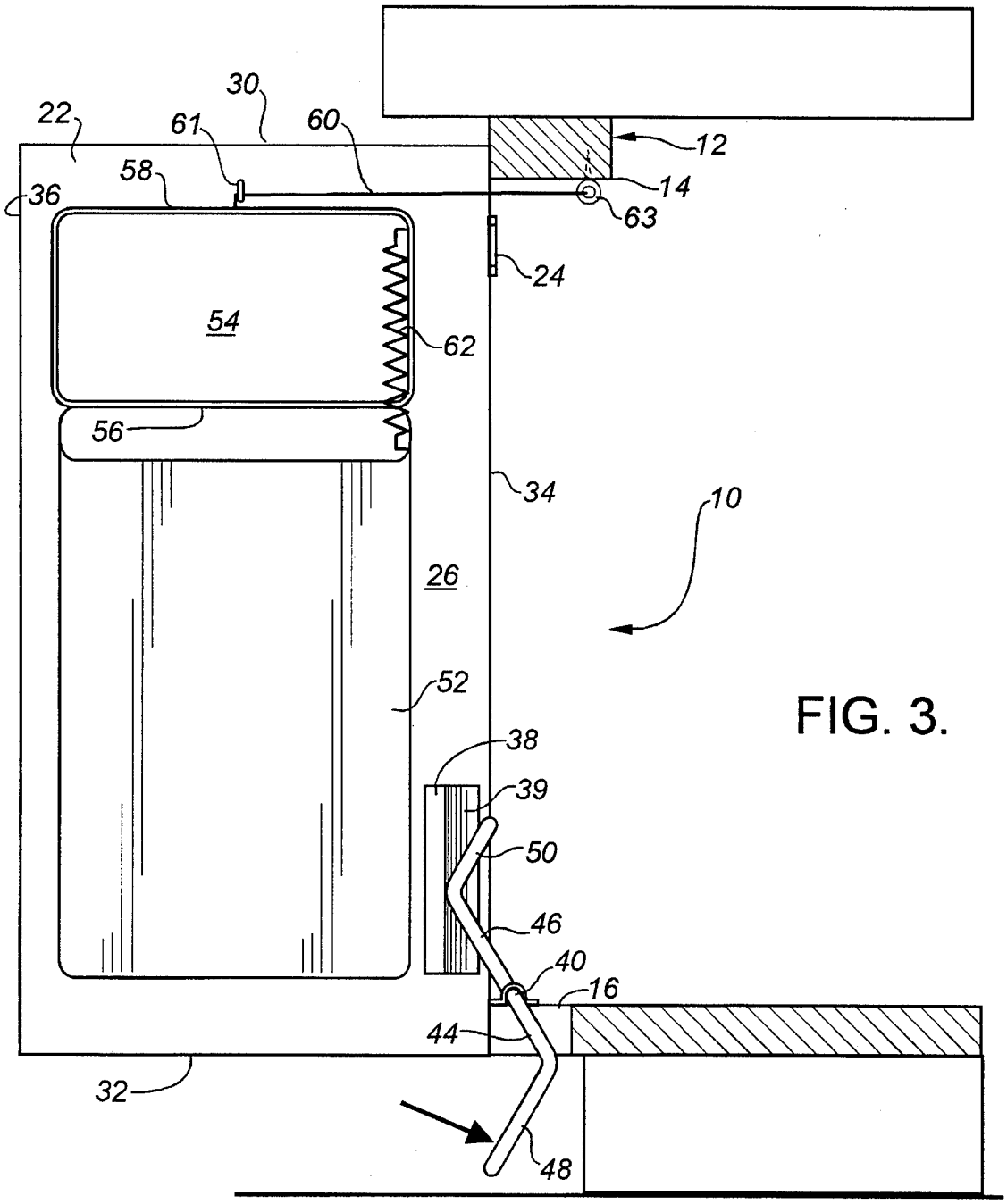
FIG. 3 is a side elevation view in section of the treadle operated door opening assembly illustrated in FIG. 1, the door being fully open.
Figure 5:
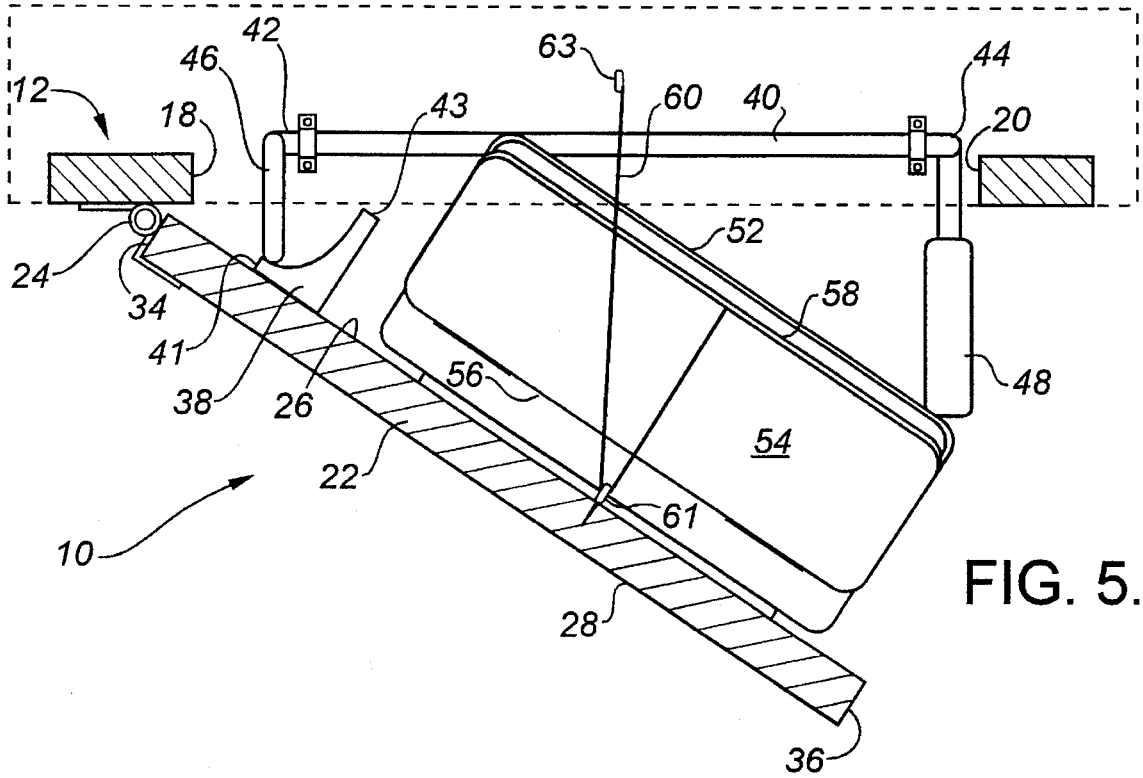
FIG. 5 is a top plan view of FIG. 2.
Figure 6:
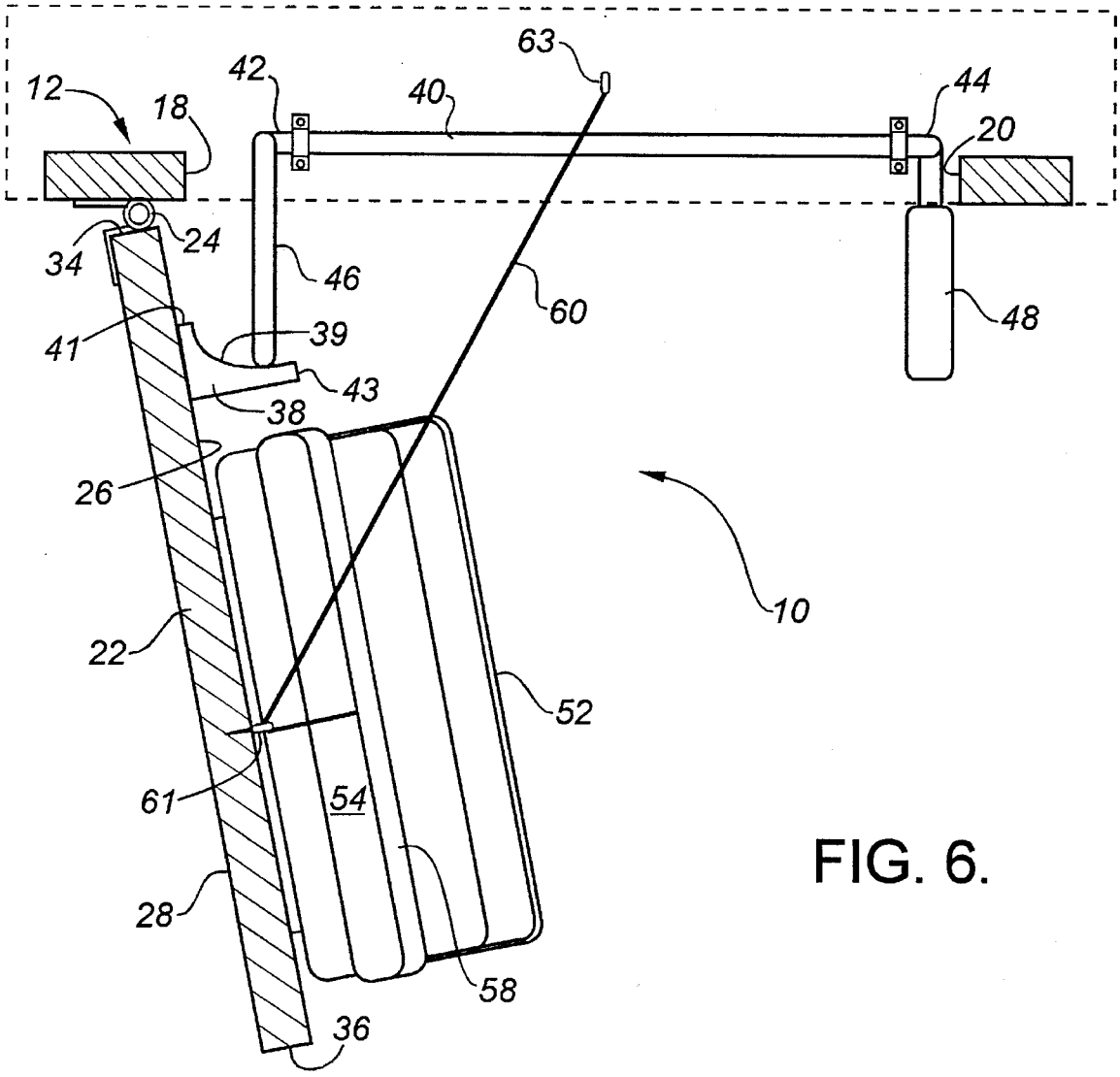
FIG. 6 is a top plan view of FIG. 3.

The use and operation of treadle operated door opening assembly will now be described with reference to FIGS. 1 through 6. The essence of the method involves mounting contact member 38 projecting outwardly from first face 26 of door 22 adjacent to hinge edge 34 and bottom edge 32. When contact member 38 is in the described position it cooperates with arm 46 to increase the controlled range of movement of door 22. When a person treads upon pedal 48, shaft 40 rotates causing a point of contact between arm 46 and door 22 to move sequentially from a first position substantially parallel to first face 26 of door 22 (as illustrated in FIG. 4) to a second position engaging contact member 38 substantially perpendicular to first face 26 of door 22 (as illustrated in FIGS. 3 and 6). This allows door 22 to be opened in a controlled manner. The transition can be made much smoother when contact member 38 has a curved contact surface 39. Referring to FIG. 4, it should be noted that when door 22 is in a closed position arm 46 is at first end 41 of curved contact surface 39. Referring to FIG. 5, it should be noted that bent portion 50 of arm 46 increases the duration of contact between arm 46 and first end 41 of curved contact surface 39 of contact member 38. Referring to FIG. 6, it should be noted that arm 46 moves along curved contact surface 39 until it reaches a position substantially perpendicular to first face 26 of door 22 at second end 43 of curved contact surface 38. Referring to FIGS. 2 and 3, with the addition of container 52, as door 22 opens lid 54 is drawn by string 60 into an open position. Spring 62 provides a biasing force to draw both lid 54 back into a closed position and door 22 back into a closed position when foot pressure is released from pedal 48.

It will be apparent to one skilled in the art that modifications may be made to the illustrated embodiment without departing from the spirit and scope of the invention as defined by the Claims. In particular, it will be apparent that contact member 38 can be made of a variety of materials and in a variety of configurations without adversely affecting its intended function. The initial proto-types of the invention used a perpendicular contact member 38. This proto-type was operative in the manner described. It is preferred, however, that contact member 38 have a curved contact surface for the reasons described above.

The embodiments of the invention in which an exclusive property or privilege is claimed are as follows:

1. A treadle operated door opening assembly, comprising:

a. a generally rectangular door frame having a top, a bottom and opposed sides;

b. a door pivotally mounted by means of hinges to one of the opposed sides of the door frame for pivotal movement about a substantially vertical axis, the door having a first face, a second face, a top edge, a bottom edge, a hinge edge, and an opening edge;

c. a contact member projecting outwardly from said first face of the door adjacent to the hinge edge and the bottom edge;

d. a shaft rotatably mounted adjacent the bottom of the door, the shaft having a first end and a second end, a radially extending arm being positioned at the first end of the shaft immediately adjacent to the contact member such that upon rotation of the shaft the arm engages the contact member, a radially extending pedal being positioned adjacent the second end of the shaft, such that when a person treads upon the pedal the shaft rotates causing the arm to move sequentially from a first position substantially parallel to the first face of the door to a second position engaging the contact member substantially perpendicular to the first face of the door thereby causing the contact member to open the door in a controlled manner; and e. a container secured to the first face of the door, the container having a lid with a first end pivotally mounted for movement about a substantially horizontal axis and a second end, a string extending from the second end of the lid to the top of the door frame such that as the door opens the lid is drawn by the string into an open position.

2. The treadle operated door opening assembly as defined in claim 1 wherein the arm is bent away from the hinge edge of the door.

3. The treadle operated door opening assembly as defined in claim 1, wherein the first face of the door faces the door frame, the contact member having a curved contact surface with a first end and a second end, the first end being substantially parallel to the first face of the door and the second end being substantially perpendicular to the first face of the door, the curved contact surface of the contact member providing a smooth transition in the movement of the arm from the first position to the second position.

4. The treadle operated door opening assembly as defined in claim 1, wherein a spring extends between the container and the second end of the lid, such that the spring provides a biasing force to draw the lid back into a closed position and the door back into the closed position when foot pressure is released from the pedal.

5. A treadle operated door opening assembly, comprising:

a. a generally rectangular door frame having a top, a bottom and opposed sides;

b. a door pivotally mounted by means of hinges to one of the opposed sides of the door frame for pivotal movement about a substantially vertical axis, the door having a first face, a second face, a top edge, a bottom edge, a hinge edge, and an opening edge, the first face of the door facing the door frame;

c. a contact member extending substantially perpendicularly from said first face of the door adjacent to the hinge edge and the bottom edge, the contact member having a curved contact surface with a first end and a second end, the first end being substantially parallel to the first face of the door and the second end being substantially perpendicular to the first face of the door;

d. a shaft rotatably mounted adjacent the bottom of the door, the shaft having a first end and a second end, a radially extending arm being positioned at the first end of the shaft immediately adjacent to the contact member such that upon rotation of the shaft the arm engages the contact member, the arm being bent away from the hinge edge of the door, a radially extending pedal being positioned adjacent the second end of the shaft, such that when a person treads upon the pedal the shaft rotates causing the arm to engage the curved contact surface of the contact member to move from a first position substantially parallel to the first face of the door to a second position substantially perpendicular to the first face of the door thereby opening the door in a controlled manner;

e. a container secured to the first face of the door,the container having a lid with a first end pivotally mounted for movement about a substantially horizontal axis and a second end, a string extending from the second end of the lid to the top of the door frame such that as the door opens the lid is drawn by the string into an open position; and f. a spring extending between the container and the second end of the lid, such that the spring provides a biasing force to draw the lid back into a closed position and the door back into the closed position when foot pressure is released from the pedal.

* * * * *